US009366240B2

(12) United States Patent
Horley et al.

(10) Patent No.: US 9,366,240 B2
(45) Date of Patent: Jun. 14, 2016

(54) SURFACE PUMP ASSEMBLY

(71) Applicant: Oilfield Equipment Development Center Limited, Victoria (SC)

(72) Inventors: Wayne Horley, Sherwood Park (CA); Jerry Evans, Leduc (CA); Richard Jackson, Thorsby (CA)

(73) Assignee: Oilfield Equipment Development Center Limited, Mahe, Victoria (SC)

( * ) Notice: Subject to any disclaimer, the term of this patent is extended or adjusted under 35 U.S.C. 154(b) by 147 days.

(21) Appl. No.: 13/692,468

(22) Filed: Dec. 3, 2012

(65) Prior Publication Data

US 2013/0183168 A1 Jul. 18, 2013

Related U.S. Application Data

(63) Continuation of application No. 11/250,922, filed on Oct. 14, 2005.

(51) Int. Cl.

| | |
|---|---|
| ***F04B 35/04*** | (2006.01) |
| ***F04B 17/03*** | (2006.01) |
| ***F04D 13/06*** | (2006.01) |
| ***F04D 29/041*** | (2006.01) |

(52) U.S. Cl.

CPC ..... *F04B 17/03* (2013.01); *F04D 13/06* (2013.01); *F04D 29/041* (2013.01)

(58) Field of Classification Search

CPC ..... F04D 13/06; F04D 25/16; F04D 25/18; F04D 11/001; F04D 11/02; F04D 25/183; F04D 11/003; F04D 11/08; F04D 9/065; F04D 25/125; F04D 25/168; F04D 29/057

USPC ..... 417/365, 423.12; 415/110; 384/168–169, 188; 310/90, 91, 156.04; 277/358–408

See application file for complete search history.

(56) References Cited

U.S. PATENT DOCUMENTS

| | | | | |
|---|---|---|---|---|
| 2,577,559 | A | | 12/1951 | Armstrong et al. |
| 3,354,952 | A | | 11/1967 | Engle |
| 3,701,912 | A | | 10/1972 | Schulze et al. |
| 3,856,368 | A | * | 12/1974 | Andersen ..... 384/485 |
| 3,944,303 | A | | 3/1976 | Ioanesian et al. |
| 4,672,249 | A | | 6/1987 | Iwata et al. |
| 4,833,354 | A | * | 5/1989 | Miller ..... 310/87 |
| 4,871,301 | A | * | 10/1989 | Buse ..... 417/420 |
| 5,048,981 | A | | 9/1991 | Ide |
| 5,340,272 | A | | 8/1994 | Fehlau |
| 5,567,133 | A | * | 10/1996 | Kobaybashi et al. ..... 417/423.7 |
| 5,613,831 | A | | 3/1997 | Liegat |
| 5,630,699 | A | | 5/1997 | Kirby et al. |
| 5,632,611 | A | * | 5/1997 | Sekiya ..... F04C 18/023 418/55.1 |
| 5,667,314 | A | | 9/1997 | Limanowka et al. |
| 5,779,434 | A | | 7/1998 | De Long |
| 5,951,248 | A | | 9/1999 | Hall |

(Continued)

FOREIGN PATENT DOCUMENTS

| | | | |
|---|---|---|---|
| GB | 768833 | A | 2/1957 |
| GB | 770520 | A | 3/1957 |

(Continued)

*Primary Examiner* — Charles Freay

(74) *Attorney, Agent, or Firm* — Patterson & Sheridan, LLP

(57) ABSTRACT

A surface mounted pump assembly includes a centrifugal pump having a plurality of impellers and an electric motor adapted to drive the pump such that a thrust load from the pump is transmitted to the motor.

3 Claims, 3 Drawing Sheets

(56) References Cited

U.S. PATENT DOCUMENTS

| | | | | |
|---|---|---|---|---|
| 5,957,656 | A * | 9/1999 | De Long | F04D 29/0465 415/104 |
| 5,960,886 | A | 10/1999 | Morrow | |
| 6,224,355 | B1 | 5/2001 | Forthuber | |
| 6,309,174 | B1 * | 10/2001 | Oklejas et al. | 415/104 |
| 6,350,109 | B1 | 2/2002 | Brunet et al. | |
| 6,450,782 | B1 | 9/2002 | Sakamoto | |
| 6,461,115 | B1 | 10/2002 | Ferrier et al. | |
| 6,698,929 | B2 | 3/2004 | Choi et al. | |
| 6,779,608 | B2 | 8/2004 | Grubb et al. | |
| 7,104,766 | B2 | 9/2006 | Mascola | |
| 2003/0219347 | A1 * | 11/2003 | Mascola | 417/365 |
| 2005/0047944 | A1 | 3/2005 | Howard | |

FOREIGN PATENT DOCUMENTS

| | | | |
|---|---|---|---|
| GB | 895616 | A | 5/1962 |
| GB | 993919 | A | 6/1965 |
| GB | 1308315 | A | 2/1973 |
| JP | 07071396 | A | 3/1995 |

* cited by examiner

SURFACE PUMP ASSEMBLY

BACKGROUND OF THE INVENTION

1. Field of the Invention

Embodiments of the present invention generally relate to a surface pump assembly for transferring fluids into or out of a well or pipeline. Particularly, embodiments of the present invention relate to a horizontal pump assembly having a centrifugal pump connected to a motor.

2. Description of the Related Art

In oil field applications fluid, like water or oil, is often pressurized and moved either between surface locations or is moved from a surface location to at least one downhole location. For example, there are instances where collected oil must be transported to a remotely located processing facility. In other instances, water is pumped down an injection well for disposal or for maintaining or increasing reservoir pressure in enhanced recovery operations or to encourage the flow of oil in underground formations to another well for recovery. In still other instances, pressurized water is injected into a wellbore to become mixed with oil and bring the oil to the surface of the well where it is separated from the water and collected.

Pumping oil out of a well that does not have adequate natural formation pressure is conventionally done through the use of an electric submersible pump located in the wellbore. The pumps operate at the end of a tubular string and include a pump and an electric motor along with a source of electrical power supplied from the surface to operate the electric motor. Because they operate in fluid at the bottom of a wellbore, electric submersible pumps are necessarily more expensive than conventional surface-mounted pumps. Additionally, repair or replacement of a submersible pump requires the removal of the entire pump assembly.

Multistage centrifugal pumps, which are similar to electrical submersible pumps, have been used at the surface to inject fluid into the wellbore. These surface mounted pumps are generally mounted horizontally with an electric motor and a thrust chamber. One advantage of the surface mounted pump is that the motor is less expensive than a downhole motor and the apparatus can be accessed for repair or replacement without pulling it out of a wellbore.

One problem associated with the surface mounted pump is that the seal between the intake chamber of the pump and the thrust chamber requires repair or replacement due to wear. The repair usually involves removing the entire thrust chamber from the pump. During the repair, the pump will be inoperable. In addition, assembly of the pump is complicated because the pump and the motor must be individually aligned with the thrust chamber.

There is a need, therefore, for an improved surface pump assembly. There is also a need for a horizontal pump having a centrifugal pump connected to a motor without a thrust chamber.

SUMMARY OF THE INVENTION

In one embodiment, a pump assembly includes a motor, a pump, and a shaft coupled to the motor and adapted to rotate the impeller, wherein a thrust load from the pump is transmitted to the motor. Preferably, the pump includes an inlet, an outlet, and at least one impeller.

In another embodiment, a method of transporting a fluid includes providing a pump assembly having a pump having a plurality of impellers; a motor for operating the impellers; and a shaft for transmitting torque to the impellers. The method also includes rotating the impellers; increasing the pressure of the fluid flowing through the pump; transmitting a thrust load from the pump to the motor; and transporting the fluid through the pump.

In another embodiment, a surface mounted pump assembly comprises a centrifugal pump having a plurality of impellers and an electric motor adapted to drive the pump such that a thrust load from the pump is transmitted to the motor.

In one or more of the embodiments disclosed herein, the motor comprises a bearing that is effective to support the thrust load.

In one or more of the embodiments disclosed herein, the motor comprises angular contact bearings.

In one or more of the embodiments disclosed herein, the pump assembly includes a mechanical seal adapted to seal the shaft against the atmosphere.

In one or more of the embodiments disclosed herein, the mechanical seal comprises a thrust bearing to support at least a portion of the thrust load.

In one or more of the embodiments disclosed herein, the shaft is coupled to the motor outside of the pump.

In one or more of the embodiments disclosed herein, the pump assembly is horizontally mounted.

In one or more of the embodiments disclosed herein, the pump assembly is mounted on a skid.

In one or more of the embodiments disclosed herein, the pump assembly is disposed on the surface of a well.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
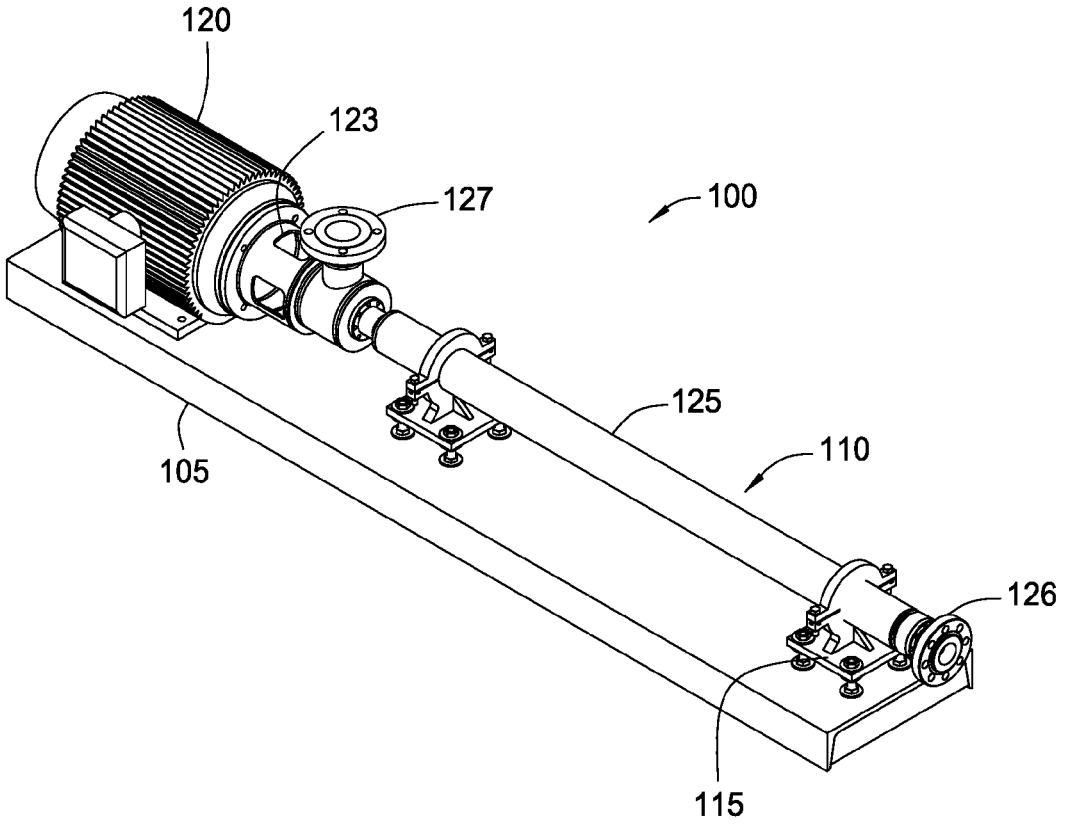
FIG. 1 is a schematic view of one embodiment of a surface pump assembly.
Figure 2:
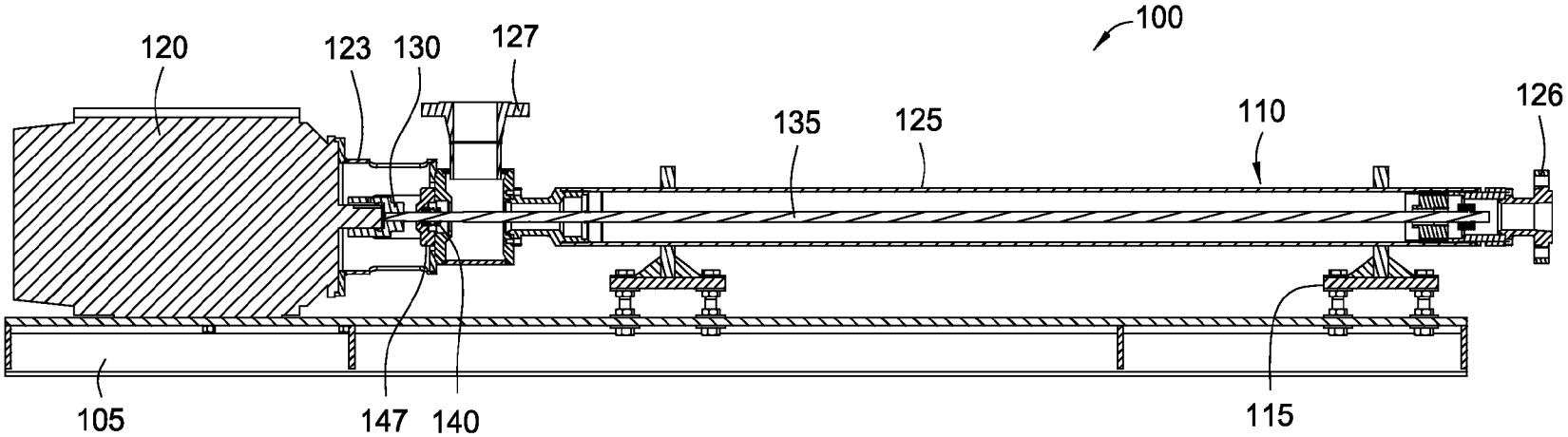
FIG. 2 is a cross-sectional view of the surface pump assembly of FIG. 1.

FIG. 1 is a schematic view of one embodiment of a surface pump assembly 100. FIG. 2 is a cross-sectional view of the surface pump assembly 100. As shown, the surface pump assembly 100 is horizontally mounted and includes a centrifugal pump 110 driven by an electric motor 120. The pump 110 is supported on a skid 105 by a plurality of support members 115. The support members 115 are adapted to prevent rotation of the pump housing 125 of the pump 110. In one embodiment, the support members 115 comprise clamp assemblies that can be bolted to the skid 105.

The pump 110 is coupled directly to the motor 120. As shown, a bell housing 123 connects the motor 120 to the intake chamber 127 of the pump 110. A coupling 130 is used to couple to the motor 120 to the shaft 135, which extends from the bell housing 123 into the pump 110. The motor 120 rotates the shaft 135 to drive the pump 110. One or more seal assemblies 140 are provided to seal around the shaft 135 as it passes through the bell housing 123 and the intake chamber 127. Any suitable seal assembly may be used so long as it is capable of sealing the intake chamber 127 from atmosphere. In one embodiment, the seal assembly 140 is a conventional mechanical seal. The mechanical seal can be a double seal having a buffer fluid supplied from an external pressurization source. In this embodiment, the buffer fluid is retained in a reservoir connected to the skid 105. The seal assembly 140 may optionally include thrust bearings 147 to absorb thrust from the pump 110. As shown in FIG. 2, the motor-shaft coupling 130 is advantageously positioned outside of the pumped fluid. As a result, the coupling 130 may be manufactured from a less expensive material.

Figure 3:
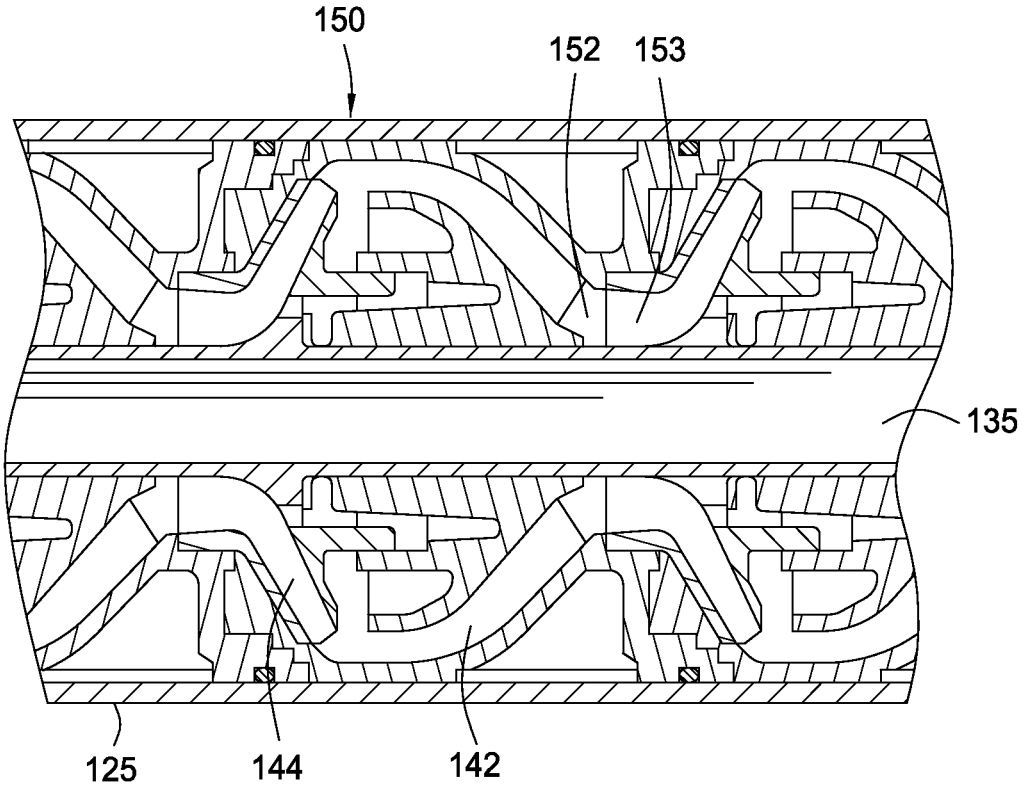
FIG. 3 is a partial cross-sectional view of the centrifugal pump.

In one embodiment, the pump 110 for the surface pump assembly 100 is a multistage centrifugal pump. The pump 110 includes the pump housing 125 connected to the intake chamber 127 at one end and a discharge flange 126 at another. FIG. 3 is a partial cross-sectional view of the pump 110. Disposed within the housing 125 is at least one diffuser 142 coupled to an impeller 144, the combination of which is commonly referred to as a "stage" 150. The impeller 144 is adapted for rotation by the shaft 135. Each impeller 144 is tightly fitted onto the shaft 135 and connected to the shaft 135 using a suitable connection mechanism, for example, a spline connection. The impeller 144 typically includes a plurality of vanes which impart momentum/velocity to the fluid, when the impeller 144 is rotated about its axis within the diffuser 142. The interaction of the fluid with the diffuser 142 converts this velocity to pressure. In this manner, the fluid pressure exiting the discharge flanged 126 may be increased.

A single stage of diffuser 142 and impeller 144 typically cannot impart the desired momentum to the fluid. Therefore, the pump 110 typically includes a plurality, or multistage, of such diffuser 142 and impeller 144 combinations. As shown, the diffusers 142 are aligned such that the centerlines of each of impellers 144 are collinear. The outlet 152 of each stage 150 delivers pumped fluid to the suction inlet 153 of the next stage 150. The first stage has the opening for receiving fluid from the intake chamber 127, and the final stage has an outlet for discharging the pumped fluid. Each diffuser 142 is configured to enable the serial interconnection of the impellers 144. Preferably, each impeller 144 includes a central hub, having a plurality of vanes extending therefrom. In one embodiment, the hub of the impeller 144 includes a recessed female portion adapted to mate with a splined male portion of an adjacent impeller 144. In this respect, the series of impellers 144 may be commonly rotated by the shaft 135. Typically, the pump 110 will include a sufficient number of stages, such that each stage 150 supplies the fluid at an incrementally higher pressure into the next adjacent stage 150. In this manner, the pump 110 is adapted increase the fluid pressure entering the intake chamber 127 and the discharge the fluid at a predetermined pressure. It must be noted other suitable centrifugal pumps known to a person of ordinary skill in the art may be also be employed.

In operation, fluid is supplied through the intake chamber 127, and the motor 120 is activated to rotate the shaft 135 and the impellers 144. Rotation of the impellers 144 increases the pressure of the fluid flowing through each stage 150. Consequently, a pressure differential is developed across each stage 150, with the discharge side having a higher pressure than the intake side. The pressure differential created during operation imparts an axial force or thrust to the shaft 135. This axial thrust is directed in the direction toward the motor 120. Because the impellers 144 are all oriented in the same direction on the shaft 135, the axial thrust from each impeller 144 is additive. This cumulative axial thrust load is transmitted directly to the motor 120.

The motor 120 is adapted to take the thrust load from the pump 110. The motor 120 is equipped with thrust bearings to carry the load of the rotors. The motor 120 may be filled with oil to provide lubrication for the bearings. In one embodiment, the thrust bearings are adapted and sized to absorb the thrust load from the motor 120, thereby improving performance and minimizing down time. Preferably, angular contact bearings are used to absorb the thrust load. It is believed that angular contact bearings, due to their design, are capable of absorbing relatively more thrust loads than radial ball bearings. It must be noted that the pump assembly 100 may be operated with any suitable electric motor known to a person of ordinary skill in the art so long as the bearings in the motor are effective to absorb the thrust load of the pump.

One advantage of the pump assembly is that manufacturing costs are significantly reduced. This is because the pump assembly may be assembled without a thrust chamber and the associated components. As a result, the assembly process is also simplified. Embodiments of the pump assembly are particularly advantageous for smaller pumping systems, preferably, pumping systems of less than 100 horsepower, and more preferably, pumping systems of less than 50 horsepower.

While the foregoing is directed to embodiments of the present invention, other and further embodiments of the invention may be devised without departing from the basic scope thereof, and the scope thereof is determined by the claims that follow.

We claim:

1. A pump assembly, comprising:

a skid;

an electric motor mounted on the skid;

a pump, comprising:

a housing mounted on the skid;

an intake chamber connected to the housing;

a discharge flange coaxial with the housing and connected to the housing at an end distal from the intake chamber;

a single shaft disposed in the housing; and a plurality of stages oriented in the same direction, each stage comprising:

a mixed axial and radial flow impeller rotationally coupled to the single shaft; and a diffuser in fluid communication with the impeller;

a bell housing directly connecting the intake chamber to the motor;

angular contact bearings disposed in the motor and operable to transmit thrust from the single shaft to the motor;

a mechanical seal disposed between the motor and the pump and around the single shaft for sealing the intake chamber from atmosphere; and a coupling directly rotationally coupling the single shaft and the motor and disposed between the mechanical seal and the motor, wherein:

the motor is filled with oil to provide lubrication for the angular contact bearings, the coupling is also disposed in the bell housing, the bell housing has a window formed through a wall thereof, and the window exposes the coupling to atmosphere.

2. The pump of claim 1, further comprising:

a second mechanical seal disposed between the motor and the pump and around the shaft, and a reservoir containing buffer fluid and in fluid communication with the mechanical seals.

3. The pump of claim 1, wherein a power of the motor is less than 100 horsepower.

* * * * *